United States Patent [19]

McGrath

[11] 3,988,518

[45] Oct. 26, 1976

[54] BATCH PLATING OF A LONG LEAD FRAME STRIP

[75] Inventor: N. Christian McGrath, Concord, N.H.

[73] Assignee: Sprague Electric Company, North Adams, Mass.

[22] Filed: Aug. 15, 1975

[21] Appl. No.: 605,103

[52] U.S. Cl. ..... 427/436; 427/438; 427/178; 427/300; 204/27; 204/206

[51] Int. Cl.[2] ..... B05D 1/18

[58] Field of Search ..... 427/436, 438, 177, 178, 427/300; 204/28, 206, 27; 118/500, 503

[56] References Cited

UNITED STATES PATENTS

| | | | |
|---|---|---|---|
| 1,312,716 | 8/1919 | Wise | 427/300 |
| 2,873,214 | 2/1959 | Schnable | 427/431 |
| 3,072,499 | 1/1963 | Cole et al. | 427/436 |
| 3,184,824 | 5/1965 | Fairbairn | 29/253 |
| 3,266,929 | 8/1966 | Lareau et al. | 427/436 |
| 3,394,441 | 7/1968 | Weiss | 427/436 |
| 3,472,665 | 10/1969 | Prueter et al. | 427/436 |

*Primary Examiner*—Ralph S. Kendall
*Assistant Examiner*—Charles R. Wolfe, Jr.
*Attorney, Agent, or Firm*—Connolly and Hutz

[57] ABSTRACT

A long metal lead frame strip is wound onto a reel with a plastic ribbon interleaved therein to separate adjacent turns of the strip on the reel. The reel is subsequently submersed in an immersion plating solution. Metal ions of the plating solution displace metal atoms at the surface of the strip to form a uniformly thick plating thereon, even in areas that are contacted by the spacing ribbon.

3 Claims, 4 Drawing Figures

BATCH PLATING OF A LONG LEAD FRAME STRIP

BACKGROUND OF THE INVENTION

The present invention relates to the batch plating of a long metal lead frame and more particularly to immersion plating on a reel.

The term immersion plating is used in the plating art and is employed herein to mean plating without an applied voltage and is accomplished at least in part by the substitution of the metal to be plated by metals in the plating bath. Immersion plating is further characterized by an inherent self limiting of the plating thickness, usually no greater than 100 microinches.

Lead frames are commonly employed in the production of electronic parts such as capacitors, inductors and transistors.

Prior to actual component assembly to a lead frame, an intermediate plating process is normally required. The usual lead frame base metal is copper or Kovar (a tradename of Westinghouse Electric Co., Blairsville, Pennsylvania). These metals are commonly plated with systems of nickel, gold, silver and in some cases tin or tin-lead alloys. These metals are plated onto the lead frame to allow subsequent component assembly operations such as eutectic semiconductor chip bonding, wire welding and/or soldering operations. The plating operation also protects the electronic components from the effects of corrosion from the lead frame base metal.

The plater normally uses the reel that the punched lead frame is wound on as a "supply" reel. The actual plating is done while the lead frame is unwound from the "supply" reel to a "takeup" reel. The mechanisms for transporting the lead frame during plating are quite sophisticated, involve substantial capital expense and require the attention of skilled operators.

Batch plating such as plating on a reel has heretofore been considered impractical particularly since the adjacent turns in a wound metal strip touch each other and effectively mask random areas from the plating solution. Otherwise batch plating requires only comparatively modest expenditures (about 1/20) for the necessary capital equipment, elimination of a source of physical distortion of the lead frame, and offers potentially reduced processing costs. A batch plating system also readily allows plating more than one long lead frame strip in the same tank at the same time.

It is therefore an object of this invention to provide a method for uniformly batch plating a long lead frame strip that is wound on a reel.

It is a further object of this invention to provide a low cost plating method for a long lead frame requiring a minimum of capital equipment.

It is yet a further object of this invention to provide a method for batch plating a plurality of long lead frame strips at once in a common plating solution.

SUMMARY OF THE INVENTION

A method for batch plating at least one long metal lead frame strip comprises winding the strip and an interleaving ribbon together on a reel to space and prevent the touching of adjacent turns of the wound strip. The reel is then submersed in an immersion plating solution containing ions of the metal to be plated. The plating is accomplished by a metal substitution reaction wherein the metal ions from the solution are substituted for metal atoms at the surfaces of the metal lead frame strip.

Immersion plating solutions are well known for use in electroless plating. The use of immersion plating in the combination of this invention has been found to provide a uniformly plated lead frame surface, even in areas that are at least partially contacted by the interleaved spacing ribbon, and therefore the plated lead frame of this invention is completely protected from corrosion and is further advantageously sealed by the plating so as to prevent contamination of the components that are to be attached thereto from the base metal of the lead frame. Immersion plating also is an inherently well controlled process providing a thin plate, generally on the order of 10 micro inches. Although basically slower than electroplating processes, the batch method of this invention provides for simultaneous submersion and plating of all strip surfaces while the electroplating of long strips is conventionally accomplished by continuously drawing the strip through the plating solution. It has been determined that the plating of one reel of lead frame by the process of this invention is several times faster than the equivalent but less well controlled continuous process for a fifty foot long lead frame. More than one reel of wound lead frames may be plated simultaneously according to this invention in the sme tank of plating solution thus permitting even greater production throughout with little more associated cost for capital equipment or operator attention.

The numerals designating the elements are consistent within the four figures.

DESCRIPTION OF THE PREFERRED EMBODIMENTS

Figure 1:
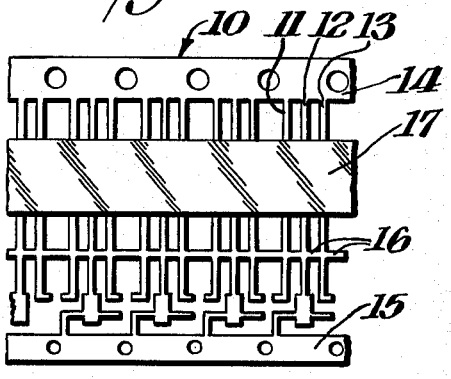
FIG. 1 shows a portion of a lead frame strip employed in the method of this invention.

A portion of a typical long metal lead frame strip 10 is shown in FIG. 1 comprised of a plurality of sets of leads. This particular lead frame is designed for the assembly of transistors thereto and the subsequent molding of the mounted transistors. For example, one lead set is designated 11, 12 and 13. The lead sets are connected by a top (as shown) rail 14, a bottom rail 15 and a series of metal webs 16. A ribbon 17 of another material is shown overlying the lead frame strip the purpose of which will become clear in the following description.

Figure 2:
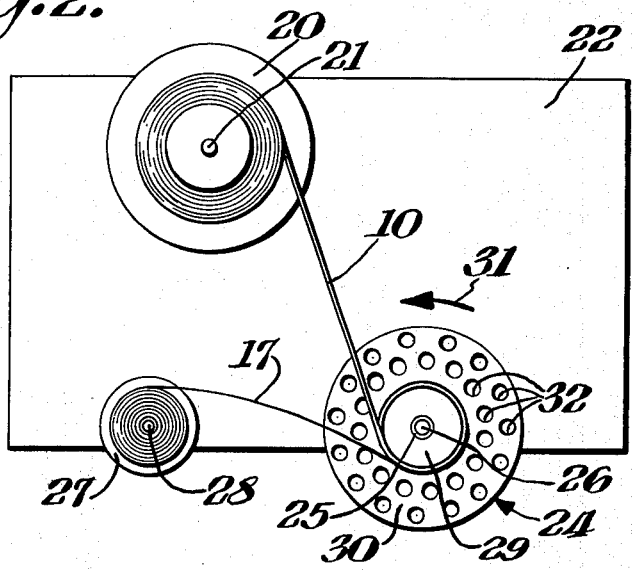
FIG. 2 shows a reeling apparatus for winding the strip of FIG. 1 on an inert reel.

Such long lead frame strips are normally wound onto a reel, after having been stamped or etched to the desired geometry. In the preferred method of this invention such a supply reel 20 is shown in FIG. 2 having the long lead frame strip 10 wound thereon. Reel 20 is mounted on a spindel 21 that is attached to a support frame 22. A take-up reel 24 has a tubular axle portion 25 that is mounted on spindel 26 that is also attached to frame 22. Also a spacer ribbon 17 is wound on a ribbon supply reel 27 that is in turn mounted on spindel 28 that is in turn attached to frame 22.

Figure 3:
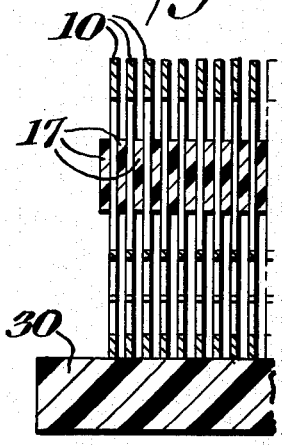
FIG. 3 shows in a cross-sectional detail view a portion of the lead frame having been wound on the inert reel of FIG. 2, taken in a plane that is radial to the reel axis.
Figure 4:
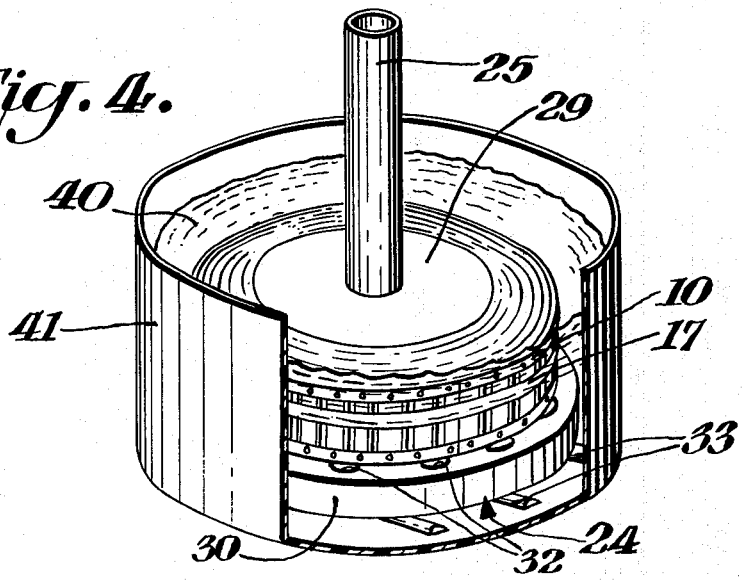
FIG. 4 shows in a perspective view the lead frame strip wound on the reel of FIG. 2 and submersed in a plating solution, a portion of the tank being cut away.

The ends of strip 10 and ribbon 17 are attached to the drum portion 29 of take-up reel 24. The take-up reel 24 is rotated by hand or by a motor (not shown) in the direction indicated by arrow 31. In this manner the lead frame strip 10 is wound onto the take-up reel 24 together with the interleaving ribbon 17. The completely wound strip 10 with ribbon 17 is shown in FIGS. 3 and 4.

The take-up reel 24 is then removed from the frame 22 and at least the reel drum portion 29 containing the wound strip is submersed in a plating solution 40 that is contained by tank 41.

Reel 24 is shown as having a rim portion 30 that serves as a guide in winding the lead frame strip thereon, and additionally serves as a base plate to secure the wound strip when the reel is submersed in the plating solution. Holes 32 are provided in this rim portion 30 to assure free access of the plating solution into the wound lead frame roll. Further toward this end, bars 33 hold the outer surface of the rim 30 away from the bottom of the tank 41.

The following example illustrates the method of this invention.

A lead frame of copper having the geometry as shown in FIG. 1 was wound together with a 0.020 inch thick nylon spacer ribbon onto a reel. The reel 24 is designed as shown in FIG. 4, being made of polypropylene. The tubular shaft 25 of the reel 24 is adapted to fit over a spindel 26 in a winding machine as illustrated in FIG. 2, while permitting other but shaftless reels (not shown) each having a center hole to be fitted on the shaft 25 of the first reel for simultaneous winding of a plurality of lead frame strips and for simultaneously submersing the plurality of wound reels in a tank containing a plating or other solutions.

The wound reel was submersed in an agitated soak cleaner (type Neutra-clean No. 7 made by the Shipley Company; Newton, Mass.) for 5 minutes at 65° C. Subsequently the reel was removed and rinsed in water for 5 minutes. After rinsing the wound reel was submersed in a tin immersion plating solution, designated LT-27 as supplied by the Shipley Company, for 5 minutes at 65° C. The reel was removed and first rinsed for 5 minutes in unheated dionized water and then rinsed in dionized water for 5 minutes at 70° C. Separate polypropylene tanks, similar to tank 41 of FIG. 4, were used for containing the liquids into which the reel was consecutively submersed. Upon unreeling, the lead frame strip was found to have a uniform dense tin plating of about 30 microinches over all surfaces.

The immersion plating of a long lead frame according to this invention may be used with plating metals and alloys other than tin, including nickel and gold. Also materials other than polypropylene and nylon will be suitable for the reel, the tank and the spacer ribbon, provided they are inert to the plating solution. A wide variety of materials such as polyurethanes, polyimides and the fluorocarbons are generally suitable for this purpose.

What is claimed is:

1. A method for batch plating at least one long lead frame strip comprising winding said one metal lead frame strip and in inert interleaving ribbon together onto an inert reel so that adjacent turns of said wound lead frame strip are spaced apart by said ribbon, and submersing and plating said one strip on said reel in an immersion plating solution containing metal ions, said immersion plating being accomplished by a metal substitution reaction wherein metal ions from said solution are substituted for metal atoms at the surfaces of said strip including those in contact with said interleaving ribbon, said metal of said lead frame strip being selected from copper and alloys thereof, said inert interleaving ribbon being selected from polyimides, polyurethanes, fluorocarbons and nylon, and said metal ions being selected from tin, nickel and gold.

2. The method of claim 1 wherein said immersion plating solution is maintained at about 65° C.

3. The method of claim 1 additionally comprising winding a second of said long lead frame strips and another inert ribbon together on another reel, and submersing and plating said second strip simultaneously in said solution.

* * * * *